US005327722A

United States Patent [19]

Clegg et al.

[11] Patent Number: 5,327,722

[45] Date of Patent: Jul. 12, 1994

[54] STAMP FORMED CONNECTOR FOR ACHIEVING EQUAL LENGTH EXHAUST PIPES

[75] Inventors: Michael W. Clegg, Toledo; Ross A. Maag, Ottawa, both of Ohio

[73] Assignee: AP Parts Manufacturing Company, Ohio

[21] Appl. No.: 103,974

[22] Filed: Aug. 9, 1993

[51] Int. Cl.[5] ..... F01N 7/10

[52] U.S. Cl. ..... 60/323; 285/150; 285/286; 285/419

[58] Field of Search ..... 285/155, 424, 373, 419, 285/286; 60/313, 323

[56] References Cited

U.S. PATENT DOCUMENTS

| | | | |
|---|---|---|---|
| 786,911 | 4/1905 | Miles et al. | 285/419 X |
| 1,271,779 | 7/1918 | Schroeder et al. | 285/424 X |
| 1,747,211 | 2/1930 | Ball | 285/155 X |
| 4,082,325 | 4/1978 | Laundy | 285/155 |
| 4,621,494 | 11/1986 | Fujita | 285/155 X |
| 5,134,852 | 8/1992 | Weeks . | |

*Primary Examiner*—Dave W. Arola

*Attorney, Agent, or Firm*—Anthony J. Casella; Gerald E. Hespos

[57] ABSTRACT

An exhaust system is provided with a stamp formed connector for joining a pair of upstream exhaust pipes to at least one downstream exhaust pipe. The connector includes a pair of plates that are formed to define opposed channels. The plates are secured in face-to-face relationship such that the channels define exhaust passages extending between the plates. The passages are curved to achieve the most desireable routing of exhaust pipes. Additionally, the exhaust pipes may be bent in close proximity to the connector to achieve most efficient routing of pipes on the vehicle. The bending of the pipes and the curved configurations of the passages in the muffler are intended to substantially equalize travel lengths for exhaust gases between upstream ends of the exhaust system and the muffler.

6 Claims, 3 Drawing Sheets

STAMP FORMED CONNECTOR FOR ACHIEVING EQUAL LENGTH EXHAUST PIPES

BACKGROUND OF THE INVENTION

1. Field of the Invention

The subject invention is directed to a stamp formed connector for joining three or more conventional pipes. The stamp formed connector enables alignment of pipes that could not readily be achieved with conventional pipe joining techniques, and enables a pipe routing to obtain equal lengths for the exhaust pipes.

2. Description of the Prior Art

Exhaust systems extend from the engine of the vehicle to a location where exhaust gases can be safely emitted. Most exhaust systems include at least one catalytic converter for converting certain objectionable pollutants into a less objectionable form. Exhaust systems also include at least one muffler to attenuate noise associated with the flowing exhaust gas.

Noise produced by an internal combustion engine is actually a sequential series of noise patterns corresponding respectively to the sequential controlled explosions taking place in the cylinders of the internal combustion engine. Engineers examine the loudness and frequency of noise resulting from these explosions and design an appropriate array of tubes and chambers in a muffler for attenuating the observed noise. The task of the engineer is made much more difficult if the noise from the respective explosions does not define a uniform repetitive pattern approaching the muffler. A non-uniform pattern may cause some waves to overlap with and add to others. Thus frequency and amplitude may be difficult to predict.

The exhaust system routing is selected to ensure sufficient clearance from components that are susceptible to damage from the heat generated by the exhaust system. The exhaust system routing also must provide a location that can safely accommodate the catalytic converter and another location that is sufficiently large to accept the exhaust muffler. Engineers evaluate these space limitations and analyze the noise generated by the muffler to design an appropriate exhaust system.

Exhaust system routing is more likely to be a problem for V-engines, such as V-8's or V-6's. Half the cylinders of a V-engine extend in a first plane, while the other cylinders extend in a second plane angularly aligned to the first plane. Thus, a V-engine includes two separate exhaust manifolds with separate exhaust pipes extending from the manifolds. Some vehicles with V-engines include entirely separate exhaust systems, with separate catalytic converters, separate mufflers and separate tail pipes. However, these entirely separate exhaust systems are costly and can complicate the problems of routing the system and identifying appropriate spaces for accommodating the catalytic converters and mufflers. Hence, most vehicles with V-engines have the respective pipes meet at a location upstream from the catalytic converter, such that exhaust gas streams from each of the two manifolds on the V-engine communicate with a single catalytic converter and a single muffler.

The typical prior art exhaust system having two exhaust pipes extending respectively from two manifolds requires a complex mitered joint where two pipes leading from the manifolds and one pipe leading to the catalytic converter are precisely cut at a selected angle to interfit with one another. The mitered pipes are aligned to one another to define a generally Y-shape and are welded securely together. The complex mitering and welding to make a Y-pipe connection is a time consuming procedure that is not well suited to a high degree of automation. Recent prior art for exhaust systems with two manifolds uses stamped components to avoid mitering. For example, U.S. Pat. No. 5,134,852 shows a pair of opposed stamped components are formed to define a first inlet, an outlet linearly aligned to the first inlet and a second inlet aligned to both the first inlet and the outlet.

The use of a V-engine with two exhaust pipes communicating with a single catalytic converter and a single muffler can complicate the acoustical tuning for an engine. In particular, physical constraints in the engine compartment and on the underside of the vehicle seldom permit a perfectly symmetrical exhaust system for a V-engine. As a result, the exhaust pipe leading from one manifold of a V-engine may be substantially longer than the exhaust pipe leading from the other manifold of the V-engine. These different lengths may result in different times for noise pulses to travel from the engine to the muffler, depending upon the side of the engine at which the pulses originate. The different travel times will result in a non-uniform pattern of noise pulses being delivered to the muffler. Thus, certain pulses may overlap with one another to create complex sound wave patterns that are more difficult to identify and attenuate.

Vehicles with transversely mounted V-engines are even more of a problem. A transversely mounted V-engine typically has one exhaust pipe that can travel fairly directly to the catalytic converter, and another exhaust pipe that must wrap substantially entirely around the engine. The stamp formed connector shown in U.S. Pat. No. 5,134,852 with the linearly aligned inlet and outlet does not solve the problems associated with an irregular pattern of pulses approaching the muffler.

In theory, pipes could be made with complex small radius bends in or near the engine compartment to facilitate exhaust system placement and alignment under the vehicle. However, small radius bends are difficult to make in view of excessive metal stretching involved. Similarly, bending equipment constraints often prevent successive bends from being immediately adjacent one another.

In view of the above, it is an object of the subject invention to provide an exhaust system that can more readily attenuate noise from a V-engine.

Another object of the subject invention is to provide an exhaust system for a V-engine having a uniform pattern of pulses approaching the muffler of the system.

A further object of the subject invention is to provide a connector for use with V-engines to facilitate complex pipe alignments and achieving more predictable noise patterns.

SUMMARY OF THE INVENTION

The subject invention is directed to a pipe connector and to an exhaust system having a pipe connector. The pipe connector of the subject invention comprises first and second formed plates that are secured in face-to-face relationship with one another. The plates are formed to define channels, and then are secured in face-to-face relationship, such that the channels define gas passages between the plates. The gas passages include a plurality of inlets and at least one outlet. The inlets are dimensioned and configured to receive downstream ends of pipes extending from engine manifolds. Thus, exhaust gases emitted by the engine manifolds will flow through pipes connected to the manifolds and into passages defined by the channels formed in the plates of the connector.

The outlet passage of the pipe connector communicates with at least one of the formed inlet passages thereof. In a first embodiment, a single outlet passage is disposed in communication with the two formed inlet passages. The outlet passage is configured to mate with an outlet pipe extending from the pipe connector to a single catalytic converter of the exhaust system. The inlet passages and the outlet passage extend circuitously through the pipe connector such that the outlet passage is angularly aligned to both inlet passages. The particular angular alignment and the particular circuitous routing of the inlet passages and the outlet passages is selected to enable an efficient routing of pipes both upstream and downstream from the pipe connector. The complex circuitous alignment of passages formed in the pipe connector can be achieved easily due to the absence of welded mitered connections. The circuitous alignment of the inlets and the outlet in the pipe connector are selected to achieve a substantially uniform length between the manifold and the location in the pipe connector at which the inlet passages meet. The equal travel length to the point of intersection will ensure that the noise pulses form the respective cylinders of the engine will arrive at the point of the intersection and at the muffler in a substantially uniformly repetitive pattern. The complex bending of pipes required to achieve these substantially equal lengths could not readily be achieved in an exhaust system formed entirely of conventional pipes that must be complexly bent and then mitered and welded together at locations in proximity to the bends.

In some embodiments, the equal lengths cannot readily be achieved at a point of intersection within the pipe connector. However, complex bends near the engine compartment combined with less severe bends downstream from the engine compartment can lead to equal pipe lengths between the engine and a muffler. For these embodiments, the pipe connector of the invention may comprise first and second inlet passages for mating respectively with first and second pipes extending from the manifolds of a V-engine. The connector may further include first and second outlet passages for connecting respectively to first and second outlet pipes extending from the pipe connector to separate catalytic converters. The inlet passages and the outlet passages of the formed pipe connector extend circuitously through the pipe connector, and are angularly aligned to one another in manners that will minimize differences between pipe lengths extending from the respective manifolds of the engine to the connector. Differences between the respective lengths can be reduced further by less severe bends downstream from the pipe connector. Although this embodiment may require separate catalytic converters, the exhaust pipes from the separate catalytic converters will lead to a single exhaust muffler.

A variation of this embodiment is to provide a second stamp formed pipe connector upstream of a single catalytic converter. The second pipe connector may include a pair of inlet passages and a single outlet passage, and communication between the inlets and the outlet is provided within the connector. The connector, the exhaust pipes between the first and second connectors can be aligned to substantially reduce or eliminate differences in length between the second pipe connector and the respective manifolds of the engine.

In each of these embodiments, the passages within the stamp formed pipe connector each include at least one bend. Additionally, a plurality of the pipes mounted to the stamp formed pipe connector include bends immediately adjacent the connector. In this manner, the pipes and the connector combine to enable successive bends closer to one another then could be provided by bending conventional pipes. Additionally, the bends within the connector can be formed with a smaller radius of curvature and/or a greater degree of bend than could realistically be obtained with conventional pipes.

DETAILED DESCRIPTION OF THE PREFERRED EMBODIMENTS

Figure 1:
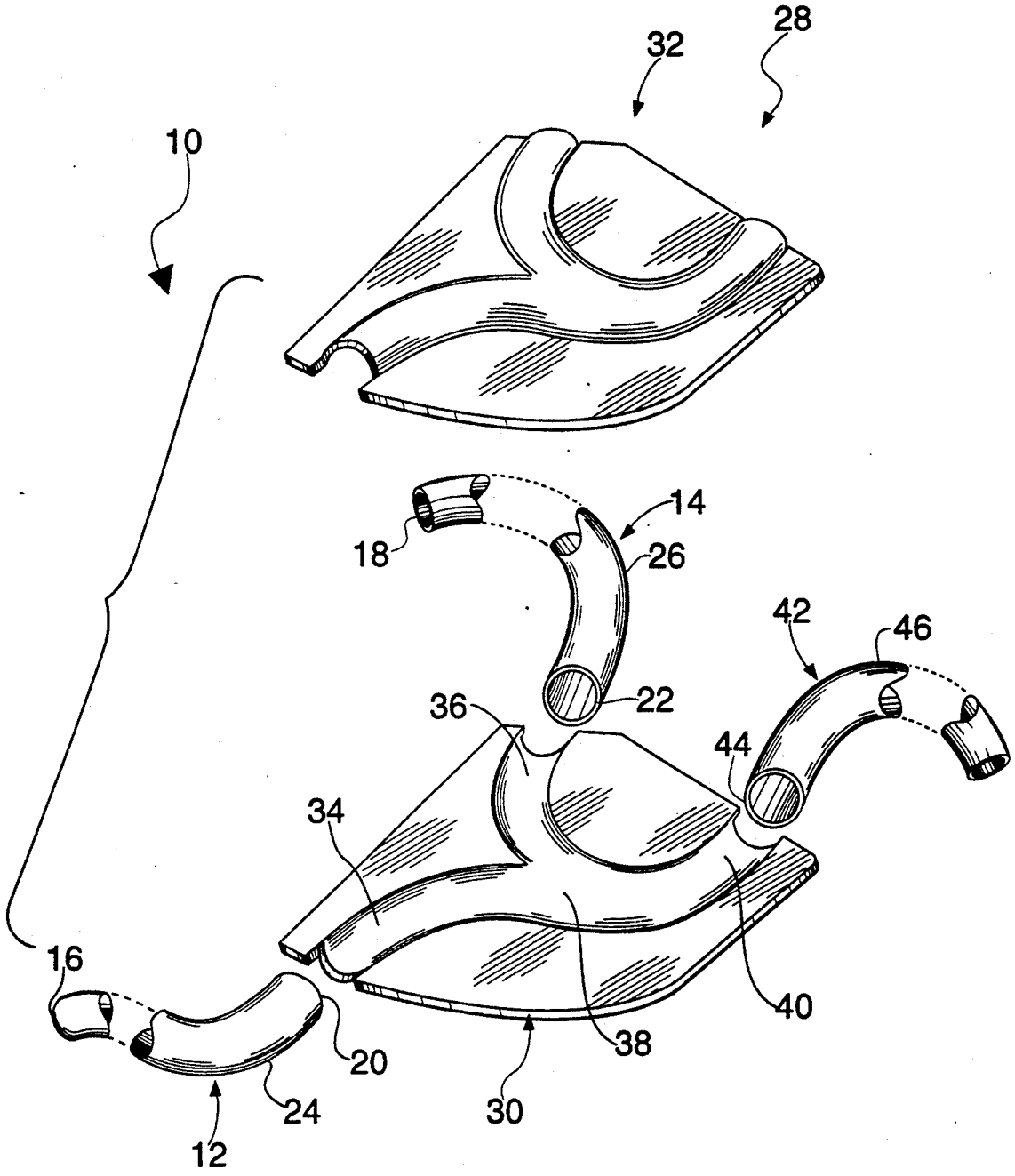
FIG. 1 is an exploded perspective view of an exhaust system component including the pipe connector of the subject invention.
Figure 2:
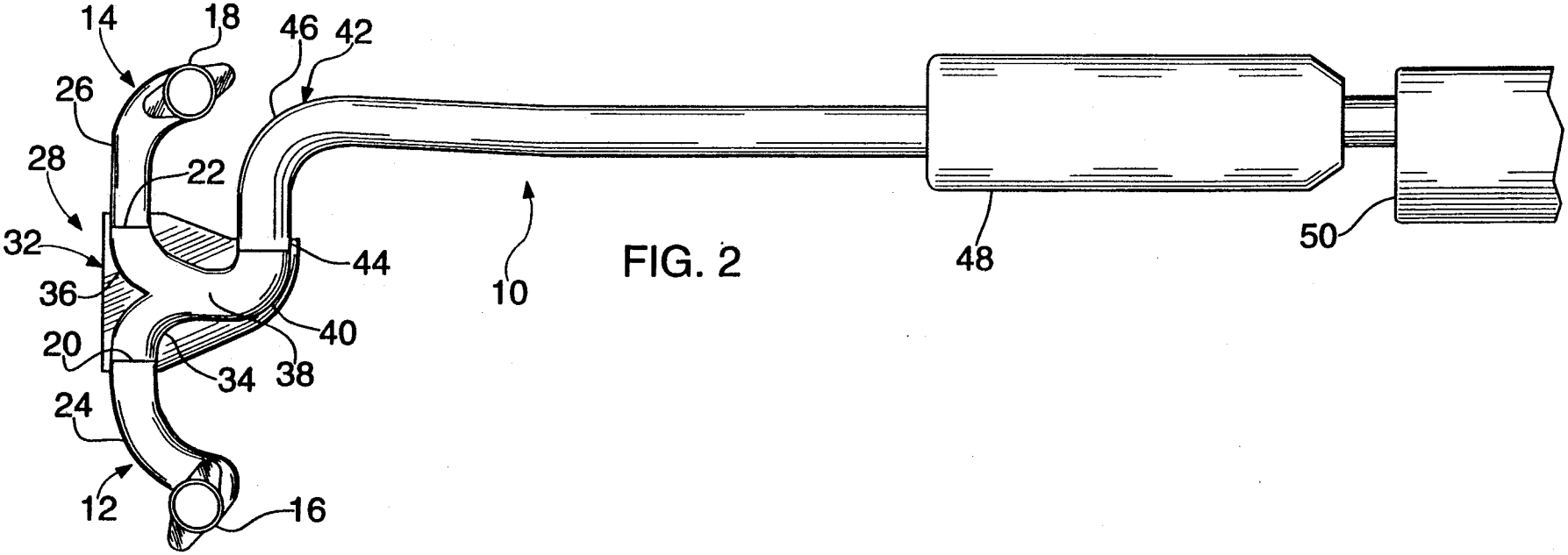
FIG. 2 is a top plan view of the assembled pipe connector shown in FIG. 1.
Figure 3:
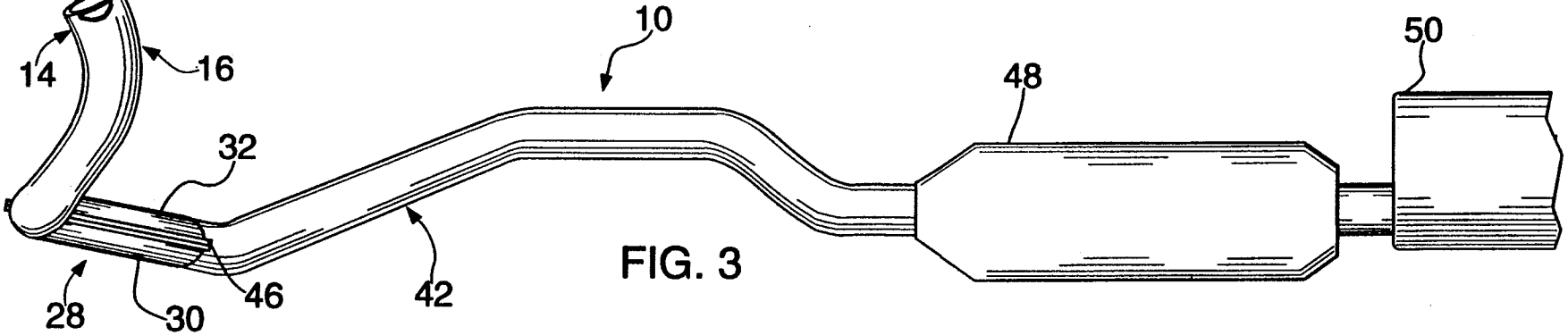
FIG. 3 is a side elevational view of the pipe connector shown in FIG. 2.

An exhaust system in accordance with the subject invention is identified generally by the numeral 10 in FIGS. 1-3. The exhaust system 10 includes first and second upstream exhaust pipes 12 and 14 which extend from manifolds (not shown) of an engine for receiving exhaust gases generated by the engine. The upstream exhaust pipes 12 and 14 include upstream ends 16 and 18 respectively, downstream ends 20 and 22 respectively and a plurality of bends therebetween. The plurality of bends include bends 24 and 26 disposed respectively in proximity to the downstream ends 20 and 22. The specific locations and dimensions of the bends in the upstream exhaust pipes 12 and 14 are designed in view of: the engine position and orientation; controls placed on the exhaust system routing by other components in and near the vehicular engine; and to make the total lengths of the respective upstream exhaust pipe 12 and 14 approximately equal. The downstream ends 20 and 22 of the upstream exhaust pipes 12 and 14 are in spaced apart angularly aligned relationship to one another. In this regard, the downstream bends 24 and 26 are provided merely to bring the ends 20 and 22 somewhat near one another and to contribute to achieving nearly the same overall lengths for the upstream exhaust pipes. In this regard, the downstream bends 24 and 26 need not have the same radius of curvature nor the same degree of bend.

The exhaust system 10 further includes a Y-pipe connector 28. The Y-pipe connector 28 includes first and second plates 30 and 32 which are configured to be secured in face-to-face relationship with one another. The first and second plates 30 and 32 are stamped formed to define oppositely directed arrays of channels which are substantially in register with one another when the plates are secured in face-to-face relationship. Thus, the channels formed in the plates 30 and 32 will define passages between the plates. The passages include first and second inlet passages 34 and 36 which are aligned respectively to mate with the downstream ends 20 and 22 of the first and second upstream exhaust pipes 12 and 14 respectively. The first and second inlet passages 34 and 36 each have well defined curves in close proximity to the downstream bends 24 and 26 on the upstream exhaust pipes 12 and 14 respectively. The close spacial relationship between the bend 24 and the associated curved passage 34, and between the bend 26 and its associated curved passage 36 provides a circuitous routing that could not realistically be achieved with conventional pipes. Additionally, the downstream bends 24 and 26 in the pipes 12 and 14 are bent around axes that are angularly aligned to the axes of curvature about which the curved passages 34 and 36 extend. Closely spaced bends around angularly aligned axes typically are difficult to achieve with conventional bending apparatus in view of the likelihood that the first bend placed in the pipe will interfere with the gripping of the pipe that is necessary to carry out the subsequent bend. The use of the Y-pipe connector as shown in FIGS. 1-3, however, avoids this problem by stamping or otherwise forming a curve in each passage 34 and 36 of the stamp formed Y-pipe connector.

The curved passages 34 and 36 of the Y-pipe connector converge at location 38 where the respective exhaust streams mix. The configuration and length of the upstream exhaust pipes 12 and 14 and the configuration and lengths of the curved inlet passages 34 and 36 preferably are selected to achieve approximately equal lengths from the upstream end 16 and 18 of the exhaust pipes 12 and 14 to the point of convergence 38 in the Y-pipe connector. With this configuration, exhaust gas from all cylinders of the engine will travel substantially equal lengths to the point of convergence 38 in the Y-pipe connector. As a result, noise pulses generated by the sequential firing of cylinders in the engine will arrive at the convergence point 38 at equally spaced and predictable intervals, and hence will be equally spaced at all locations downstream from point 38.

The Y-pipe connector 28 further includes an outlet passage 40 which extends arcuately from the point of convergence 38 to a peripheral region of the Y-pipe connector. The curved shape of the outlet passage 40 is selected to achieve an efficient alignment to other portions of the exhaust system as explained further herein. The curve of the outlet passage 40 is in close proximity to the curves 34 and 36 of the inlet passages 34 and 36. As noted above, such curves could not realistically be achieved in such close proximity with conventional pipes. Furthermore, such curves would complicate any mitered cutting and welding that had been used in the prior art.

The exhaust system 10 further includes a downstream exhaust pipe 42 having an upstream end 44 connected to the outlet passage 40 of the Y-pipe connector 28. The downstream exhaust pipe 42 further includes an upstream bend 46 substantially adjacent the end 44. The curved outlet passage 40 and the upstream bend 46 in the exhaust pipe 42 are configured to enable the most efficient alignment of portions of the exhaust system downstream of the Y-pipe connector 28. The close proximity of the curved outlet passage 40 and the upstream bend 46 in the exhaust pipe 42 would not be achievable in an exhaust system relying entirely on conventional pipes.

The downstream exhaust pipe 42 extends to a catalytic converter 48 which is operative to convert certain pollutants in the exhaust stream into a less objectionable form. The exhaust system 10 further includes a muffler 50 communicating with the catalytic converter 48 for attenuating significant portions of the noise associated with the flowing exhaust gas. It will be noted that all exhaust gas will travel the same path from the point of convergence 38 in the Y-pipe connector 28 to the exhaust muffler 50. Additionally, as noted above, the curved configurations of the upstream exhaust pipes 12 and 14 and the curved inlet passages 34 and 36 are selected to achieve substantially equal lengths from the manifolds to the point of convergence 38 in the Y-pipe connector 28. Hence, exhaust gas from either manifold will travel substantially identical distances to the muffler 50, thereby facilitating acoustical tuning functions of the exhaust system 10.

Figure 4:
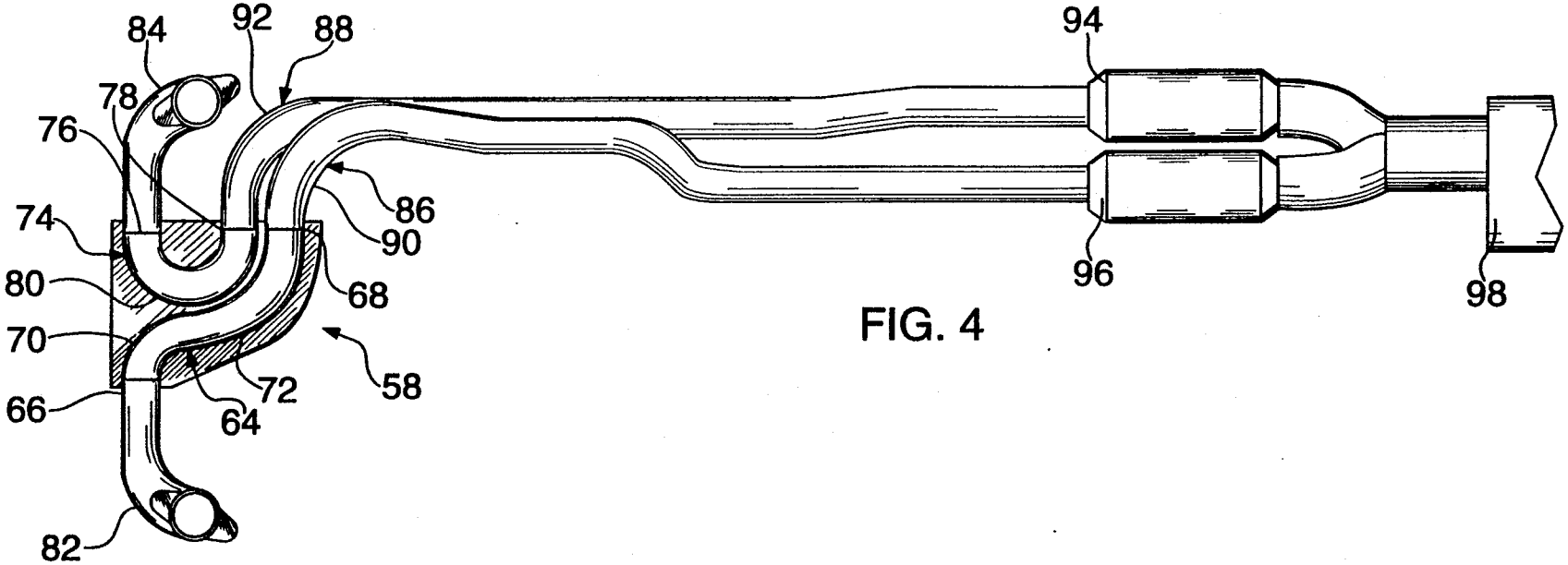
FIG. 4 is a top elevational view of an alternate pipe connector.
Figure 5:
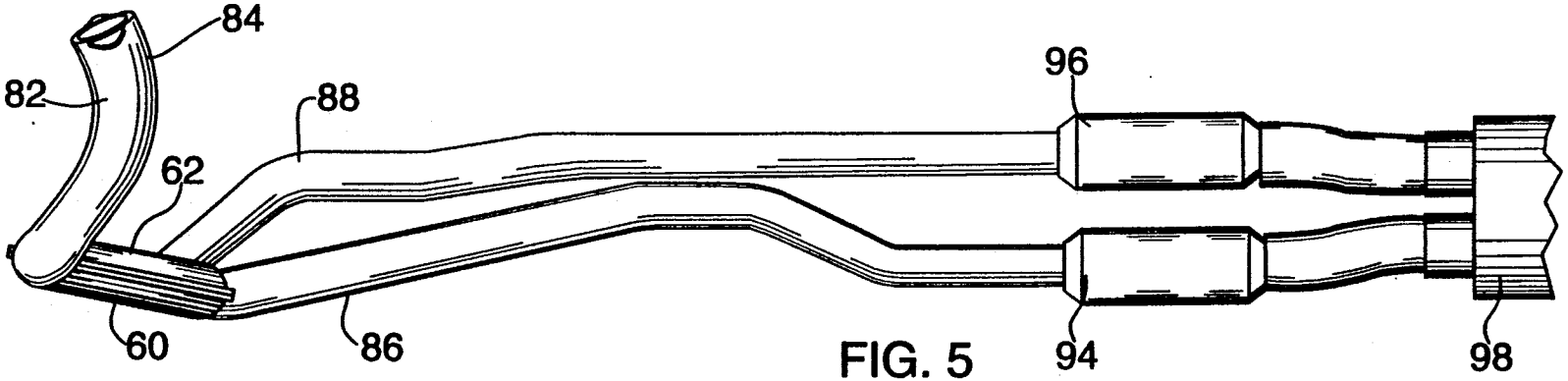
FIG. 5 is a side elevational view of the pipe connector shown in FIG. 4.

An alternate embodiment of a stamp formed pipe connector is illustrated in FIGS. 4 and 5, and is identified generally by the numeral 58. The pipe connector 58 includes first and second formed plates 60 and 62. As in the previous embodiment, the plates 60 and 62 are configured to be placed in registration with one another. The plates 60 and 62 also are formed with channels which generally register with one another when the plates are connected. Thus, the channels in the plates 60 and 62 define exhaust gas passages. Unlike the previous embodiment, however, the exhaust gas passages in the pipe connector 58 define two entirely separate passages, with no point of convergence as in the previous embodiment. More particularly, the connector 58 includes a first through passage 64 having an inlet end 66 and an outlet end 68. The passage 64 includes first and second curves 70 and 72 respectively. A second through passage 74 includes an inlet 76 and an outlet 78 and a single curve 80 extending through approximately 180°. As in the previous embodiment, the pipe connector 58 is joined to a pair of upstream exhaust pipes 82 and 84, each of which has a plurality of bends, including bends adjacent to the inlet ends 66 and 76 of the respective passages 64 and 74. Thus, as in the previous embodiment, the bends in the pipes 82 and 84 are in very close proximity to the curves 70 and 80 respectively formed in the passages 64 and 74 of the pipe connector 58. As noted above, these complex small radius bends in close proximity to one another are very difficult to form using systems entirely of conventional pipes. The radii of the curves 70, 72 and 80 and the degrees of curvature thereof are selected to achieve the most efficient routing for the exhaust system. Additionally, the alignment of the passages 64 and 74 are selected to make the respective lengths of the pipes approximately equal.

Unlike the previous embodiment, the inlets to the pipe connector 58 do not converge within the pipe connector. Rather, two separate downstream exhaust pipes 86 and 88 are secured to the pipe connector at the outlets 68 and 78 respectively of the passages 64 and 74. It will be noted that the downstream exhaust pipes 86 and 88 are provided respectively with bends 90 and 92 immediately adjacent the outlets 68 and 78 of the passages 64 and 74. Thus, as in the previous embodiment, exhaust gas undergoes significant directional changes within a very small space.

The downstream exhaust pipe 88 extends substantially linearly from the connector 58 to a catalytic converter 94. The downstream exhaust pipe 86 extends to a catalytic converter 96, but includes a plurality of bends. The catalytic converters 94 and 96 then communicate with the single muffler 98. The bends in the downstream exhaust pipes 86 and 88 conform to available space on the underside of the vehicle, and also are intended to substantially equalize the distances exhaust gases will travel between the engine and the muffler 98. Thus, whereas the previous embodiment was able to obtain substantially equal distances at the connector, the embodiment shown in FIGS. 4 and 5 requires additional distance to obtain equal travel lengths.

In summary, connectors are provided for joining a pair of upstream exhaust pipes with at least one downstream exhaust pipe. The connector is defined by a pair of plates that are stamped to define a plurality of passages therebetween for flowing exhaust gas. The passages defined within the connector include a plurality of complex bends. Portions of pipes connected to the passages also include bends in close proximity to the connector. The connector enables complexly bent pipe shapes that could not readily be achieved with conventional pipes. Additionally, the connector avoids the complex mitering and welding common in the prior art. Additionally, the curves in the passageways and the bends in the pipe are provided to achieve optimum routing and positioning of the exhaust system and to substantially equalize the travel distance for exhaust gases between the engine and the muffler of the exhaust system. As a result, noise pulses will arrive at the muffler in a uniform pattern and can be attenuated more easily by the muffler.

While the invention has been described with respect to a preferred embodiment, it is apparent that various changes can be made without departing from the scope of the invention as defined by the appended claims.

What is claimed is:

1. An exhaust pipe connector for an exhaust system carrying exhaust gases from an engine to a muffler, said connector comprising first and second plates secured in face-to-face relationship, said plates being formed with channels disposed for defining exhaust passages between the plates, said exhaust passages including a pair of inlet passages and a single outlet passage the inlet passages and said outlet passage converging at a selected location within said connector, each of said inlet passages and said outlet passage between said plates of said connector being curved to achieve a selected routing of exhaust system components and to substantially equalize travel length for exhaust gases travelling to a muffler.

2. A connector as in claim 1, wherein the curve in said outlet passage extends through an angle of approximately 90°.

3. A connector as in claim 1, wherein the curves in said inlet passages extend through angles of at least approximately 45°.

4. An exhaust system including first and second upstream exhaust pipes having opposed upstream and downstream ends and a plurality of bends therebetween, said bends including downstream bends disposed in proximity to the respective downstream ends of said upstream exhaust pipes, a pipe connector comprising first and second plates formed with channels and connected in face-to-face relationship with one another such that the channels define exhaust gas passages between said plates, said passages including first and second inlet passages welded respectively to said first and second upstream exhaust pipes and an outlet passage, said inlet passages of said connector converging with one another and communicating with said outlet passage, each of said inlet passages and said outlet passage including curves, a downstream exhaust pipe having an upstream end welded to said outlet passage of said connector, and a muffler communicating with said downstream exhaust pipe, said curves of said passages in said connector being configured to achieve efficient alignment of said upstream and downstream exhaust pipes and to provide substantially equal exhaust gas travel lengths for exhaust gas flowing to said muffler.

5. An exhaust system as in claim 4, wherein said downstream exhaust pipe includes a bend in proximity to said upstream end.

6. An exhaust system including first and second upstream exhaust pipe having opposed upstream and downstream ends and a plurality of bends therebetween, said bends included downstream bends disposed in proximity to the respective downstream ends of said upstream exhaust pipes, a pipe connector comprising first and second plates formed with channels and connected in face-to-face relationship with one another such that the channels define exhaust gas passages between said plates, said passages including first and second inlet passages welded respectively to said first and second upstream exhaust pipes and first and second outlet passages communicating respectively with said first and second inlet passages, first and second downstream exhaust pipes having upstream ends welded respectively to said first and second outlet passages of said connector and a muffler communicating with both of said first and second downstream exhaust pipes, said inlet and outlet passages of said connector each being curved for achieving selected alignment of the upstream and downstream exhaust pipes and for substantially equalizing travel lengths for exhaust gas flowing to the muffler.

* * * * *